US005791226A

United States Patent [19]

Chung et al.

[11] Patent Number: 5,791,226

[45] Date of Patent: Aug. 11, 1998

[54] FLUID REGENERATION DEVICE FOR CONSTRUCTION VEHICLES

[75] Inventors: Tae Seung Chung, Pusan; Yang Goo Lee, Changwon, both of Rep. of Korea

[73] Assignee: Samsung Heavy Industries Co., Ltd., Rep. of Korea

[21] Appl. No.: 762,987

[22] Filed: Dec. 10, 1996

[30] Foreign Application Priority Data

May 25, 1996 [KR] Rep. of Korea ..... 1996-17894

[51] Int. Cl.[6] ..... F15B 13/04

[52] U.S. Cl. ..... 91/29; 91/31; 91/420; 91/436

[58] Field of Search ..... 91/6, 28, 29, 31, 91/420, 435, 436, 458

[56] References Cited

U.S. PATENT DOCUMENTS

| | | | |
|---|---|---|---|
| 4,323,095 | 4/1982 | Acerbi | 91/420 X |
| 4,359,931 | 11/1982 | Palmersheim et al. . | |
| 4,723,476 | 2/1988 | Stucky | 91/436 |
| 4,727,792 | 3/1988 | Haussler | 91/420 |
| 4,836,088 | 6/1989 | Seabaugh . | |
| 5,065,664 | 11/1991 | Ohta et al. | 91/436 X |
| 5,220,862 | 6/1993 | Schexnayder . | |
| 5,237,916 | 8/1993 | Malashenko . | |
| 5,263,400 | 11/1993 | Huesser | 91/420 |
| 5,370,038 | 12/1994 | Poppe et al. . | |
| 5,400,816 | 3/1995 | Gerstenberger | 91/420 X |
| 5,415,076 | 5/1995 | Krone et al. . | |

*Primary Examiner*—Hoang Nguyen
*Attorney, Agent, or Firm*—Harness, Dickey & Pierce, P.L.C.

[57] ABSTRACT

A return fluid regeneration device for construction vehicles is provided. The regeneration device includes an orifice disposed on a return-side internal line of a directional control valve of an actuator. A regeneration line is arranged between the return-side internal line and a return line extending to a return tank and is further selectively connected to the return-side internal line during a weight operation of the actuator. A regeneration branch line is branched from the return-side internal line and is connected to a supply-side internal line of the valve, thus selectively feeding the return fluid from the return-side internal line to the supply-side internal line and thereby regenerating the return fluid. First and second check valve are also provided on the regeneration line and branch line, respectively. The regeneration device regulates the moving speed of the actuator while simultaneously preventing the generation of high pressure in a fluid supply line.

2 Claims, 2 Drawing Sheets

FLUID REGENERATION DEVICE FOR CONSTRUCTION VEHICLES

BACKGROUND OF THE INVENTION

1. Field of the Invention

The present invention relates, in general, to a return fluid regeneration device used in a hydraulic circuit for construction vehicles and, more particularly, to a regeneration device used in a cylinder actuator, such as the boom, arm or bucket cylinder, of a power excavator in order to generate a back pressure in a fluid return line, thereby regulating the moving speed of the actuator while simultaneously preventing the generation of high pressure in a fluid supply line extending to the actuator.

2. Description of the Prior Art

In a hydraulic circuit for construction vehicles such as power excavators, "regeneration of fluid" means that return fluid in a fluid return line extending from an actuator is fed back to a fluid supply line extending to the actuator, thereby preventing the generation of cavitation in the fluid supply line due to a shortage of pressurized fluid in the fluid supply line and regulating the moving speed of the actuator.

In order to regenerate the return fluid from an actuator in a construction vehicle's hydraulic circuit, it must be possible to selectively operate the actuator by the weight of an associated working member in place of pressurized fluid output from a hydraulic pump. For example, in operation of a power excavator, return fluid under high pressure is obtained by the weight of a boom during a boom-down motion and in turn is used in a boom-up motion.

FIG. 1 is a view showing the construction of a directional control valve or arm control valve, which is used for controlling the flow direction of fluid for an arm cylinder and has a typical regeneration circuit. FIG. 2 is a circuit diagram showing the construction of a hydraulic circuit provided with the arm control valve of FIG. 1. As shown in FIGS. 1 and 2, the arm cylinder ARM is connected to a hydraulic pump P through first and second fluid lines 101*a* and 101*b*, with the arm control valve CV being mounted to the lines 101*a* and 101*b*. In the arm control valve CV, a spool linearly moves in a valve block in response to an operator's control signal 100, 101, thereby switching the internal lines of the valve CV and controlling the flow direction of fluid, which is supplied from the pump P to the arm cylinder ARM.

The arm control valve CV thus starts or stops the arm cylinder ARM and controls the moving direction of the cylinder ARM.

That is, when the valve CV is switched into the neutral position, the internal lines except for the center bypass line 103 are closed, so that the pressurized fluid output from the pump P does not flow to the arm cylinder ARM but returns to the tank T through the bypass line 103. When the valve CV is switched into the first position I, the pressurized fluid from the pump P passes through the output fluid line 102, the supply-side internal line 104 of the valve CV and the first fluid line 101*a*, thus being fed to the large chamber of the arm cylinder ARM. In this case, the fluid in the small chamber of the arm cylinder ARM returns to the tank T through the second fluid line 101*b* and the return-side internal line 107 of the valve CV. The arm cylinder ARM in the above state is brought into a piston rod retracting motion and thereby performs an arm-in motion. Meanwhile, when the valve CV is switched into the second position II, the pressurized fluid from the pump P passes through the internal line of the valve CV and the second line 101*b*, thus being applied to the small chamber of the arm cylinder ARM. In this case, the fluid in the large chamber of the arm cylinder ARM returns to the tank T through the first fluid line 101*a* and the internal line of the valve CV. The arm cylinder ARM in the above state is brought into a piston rod extending motion and thereby performs an arm-out motion.

When the arm control valve CV is switched into the first position I thereby performing an arm-in motion, a back pressure is generated in the return-side internal line 107 of the valve CV due to an orifice 108. When the back pressure inside the line 107 is higher than a preset pressure of a valve spring 106*a* of a check valve 106, the return fluid passing through the line 107 of the valve CV is partially fed back to the supply-side internal line 104 through a regeneration line 105, which is branched from the return-side internal line 107. The return fluid in the line 107 is thus partially regenerated. In the supply-side internal line 104, the regenerated return fluid is mixed with the pressurized fluid output from the pump P and in turn is fed to the large chamber of the arm cylinder ARM through the first fluid line 101*a*.

In FIG. 1, the reference character RV denotes a relief valve, T denotes a tank passage and P denotes a pump passage.

However, the above regeneration circuit has the following problems. First, it is not necessary to generate a high operational pressure in the fluid supply line for the arm cylinder ARM, when the arm moves under a loadless state.

However, the return fluid flowing in the return-side internal line 107 is always partially regenerated due to the weight of the arm and thereby unnecessarily applies a high operational pressure to the fluid supply line in the above state.

Second, the return fluid, which determines the moving speed of the arm cylinder ARM, flows through the orifice 108 and the check valve 106 of the regeneration line 105.

Therefore, the moving speed of the arm is largely affected by the flow rate of the regenerated return fluid, thereby causing the moving speed of the arm cylinder ARM to be largely changed in accordance with the load applied to the arm. In the above case, the moving speed of the arm cylinder ARM cannot be determined by the orifice cross-sectional area, which is formed in the arm control valve CV and is controlled by movement of the spool inside the valve block. Therefore, the arm cylinder ARM fails to precisely move in response to an operator's control signal, so that it is almost impossible to precisely control the movement of the arm.

SUMMARY OF THE INVENTION

It is, therefore, an object of the present invention to provide a return fluid regeneration device of a hydraulic circuit for construction vehicles in which the above problems can be overcome and which forms a back pressure in the return line of an actuator, thereby preventing return fluid of the actuator from rapidly flowing from the return line into the supply line and thereby regulating the moving speed of the actuator while simultaneously preventing the generation of high pressure in the supply line due to the regenerated return fluid.

In order to accomplish the above object, the present invention provides a regeneration device for feeding back return fluid to a fluid supply line for an actuator being operable by the weight of an associated working member of a construction vehicle, thereby regenerating the return fluid.

The device includes an orifice which is provided on a return-side internal line of a directional control valve of the actuator. A regeneration line is arranged between the return-side internal line and a return line extending to a return tank and is selectively connected to the return-side internal line during a weight operation of the actuator. A regeneration branch line is branched from the return-side internal line at a position after the orifice and is connected to a supply-side internal line of the control valve, thus selectively feeding the return fluid from the return-side internal line to the supply-side internal line and thereby regenerating the return fluid.

In the preferred embodiment, a first check valve is provided on the regeneration line in order to selectively form a back pressure in the regeneration line.

In addition, a second check valve is provided on the regeneration branch line in order to prevent the reverse flow of fluid from the supply-side internal line to the return-side internal line.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

In the following description, the regeneration device according to the preferred embodiment of this invention is used in, for example, an arm control valve of a power excavator. However, it should be understood that the regeneration device may be used in a boom control valve, bucket control valve or other directional control valve.

Figure 4:
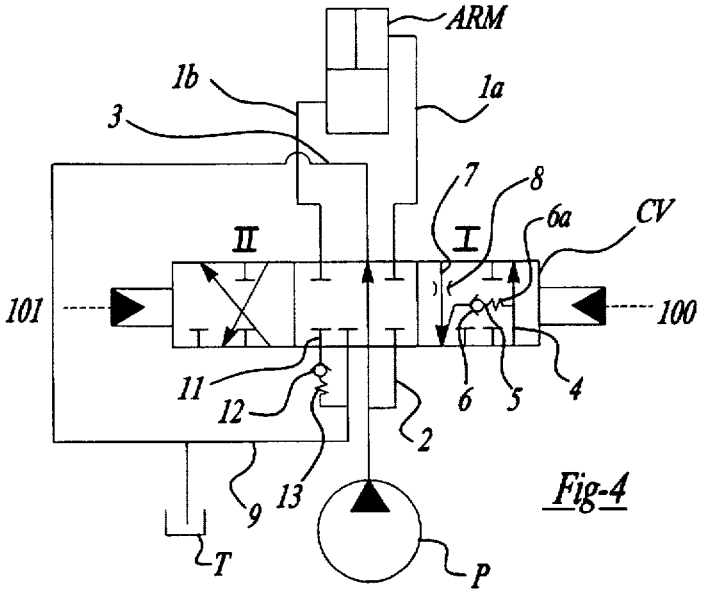
FIG. 4 is a circuit diagram showing the construction of the hydraulic circuit provided with the arm control valve of FIG. 3.
Figure 3:
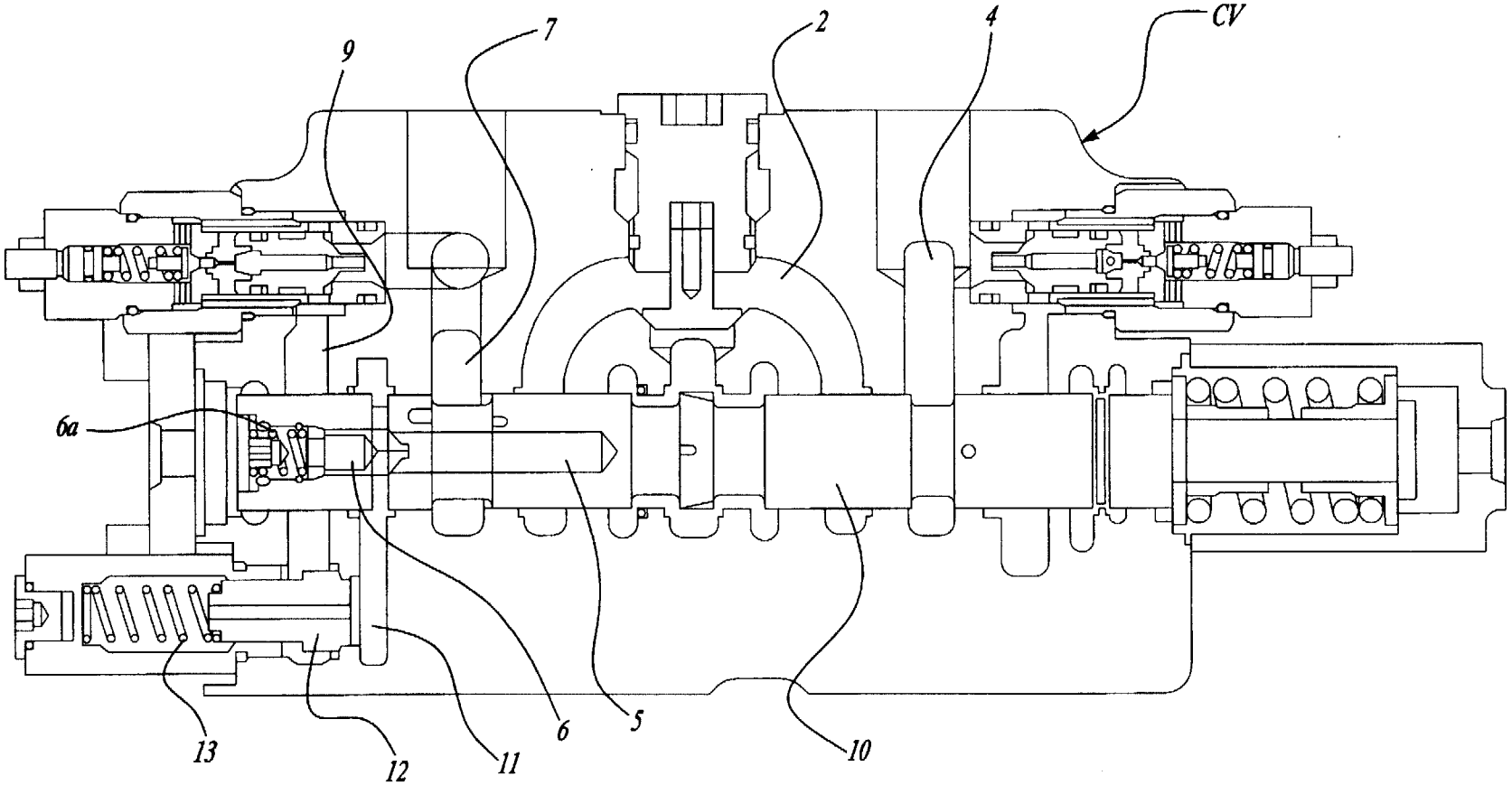
FIG. 3 is a view showing the construction of an arm control valve having a regeneration device in accordance with the preferred embodiment of the present invention.

FIG. 3 is a view showing the construction of an arm control valve having the regeneration device in accordance with the preferred embodiment of the present invention. FIG. 4 is a circuit diagram showing the hydraulic circuit provided with the arm control valve of FIG. 3.

Figure 1:
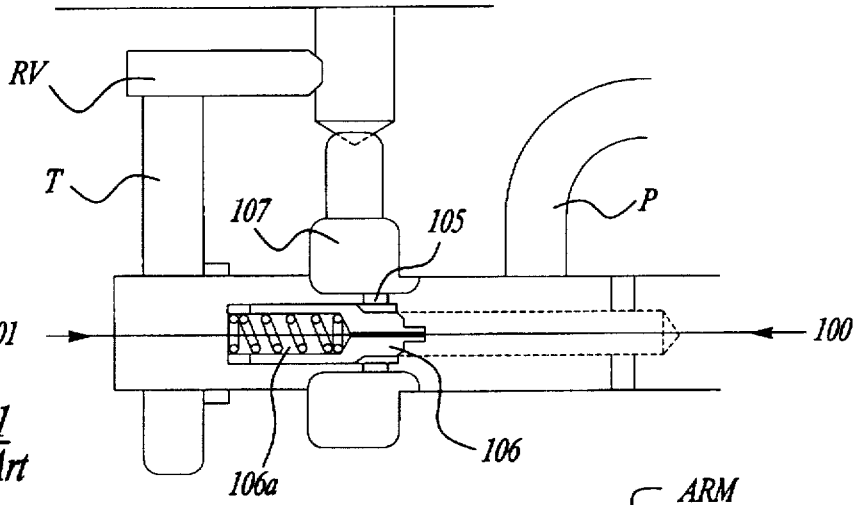
Fig-1 Prior Art
FIG. 1 is a view showing the construction of an arm control valve, which is used for controlling the flow direction of fluid for an arm cylinder and has a typical regeneration circuit.
Figure 2:
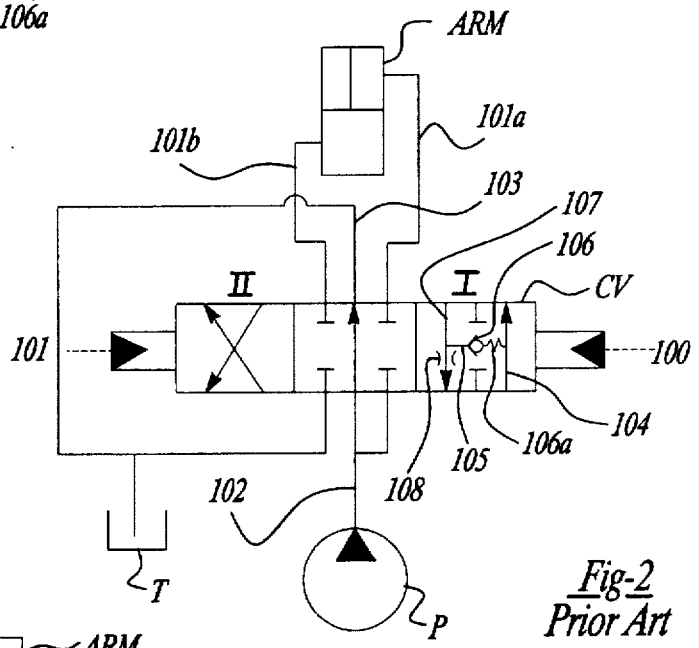
Fig-2 Prior Art
FIG. 2 is a circuit diagram showing the construction of the hydraulic circuit provided with the arm control valve of FIG. 1.

As shown in FIGS. 3 and 4, the arm cylinder ARM is connected to a hydraulic pump P through first and second fluid lines 1*a* and 1*b*, with the arm control valve CV being mounted to the fluid lines 1*a* and 1*b*. The construction and operation of the hydraulic circuit including the arm control valve CV were described in detail in the prior art embodiment of FIGS. 1 and 2 and further explanation is thus not deemed necessary.

The regeneration device according to this invention has a return-side internal line 7, which is provided in the arm control valve CV and is selectively connected to the second line 1*b* of the arm cylinder ARM when the spool of the valve CV is switched into the first position I in response to an operator's control signal 100. An orifice 8 is provided on the return-side internal line 7 of the valve CV. The regeneration device also has a regeneration line 11, which extends from the return-side internal line 7 to a return line 9 extending to a return tank T. The regeneration line 11 is selectively connected to the return-side internal line 7 while the arm cylinder ARM actuates the arm in order to bring the arm into an arm-in motion. A spring-biased first check valve 12 is provided on the regeneration line 11. The first check valve 12 is elastically biased by a valve spring 13 with a preset pressure. The orifice 8 forms a back pressure in the return line 1*b* of the arm cylinder ARM, thereby preventing the moving speed of the arm cylinder ARM from being increased due to rapid flow of the return fluid from the line 7 to a supply-side internal line 4 during a loadless movement of the arm.

Therefore, the moving speed of the arm cylinder ARM can be precisely controlled by linear movement of the spool in the valve block of the arm control valve CV in response to the operator's control signal. A regeneration branch line 5 is branched from the return-side internal line 7 at a position after the orifice 8 and is connected to the supply-side internal line 4 of the control valve CV. A spring-biased second check valve 6 is provided on the regeneration branch line 5. The second check valve 6 is elastically biased by a valve spring 6*a* with a preset pressure, so that the valve 6 prevents the reverse flow of pressurized fluid from the supply-side internal line 4 to the return-side internal line 7 when the regeneration branch line 5 is opened.

The operational effect of the above regeneration device will be described hereinbelow.

When the arm control valve CV is switched into the first position I in response to an operator's control signal 100, the pressurized fluid from the pump P passes through the output fluid line 2, the supply-side internal line 4 of the valve CV and the first fluid line 1*a*, thus being applied to the large chamber of the arm cylinder ARM. In this case, the fluid in the small chamber of the arm cylinder ARM flows through the second fluid line 1*b*, the return-side internal line 7 of the valve CV, orifice 8, regeneration line 11, the first check valve 12 and return line 9, thus returning to the tank T. The arm cylinder ARM in the above state is brought into a piston rod retracting motion and thereby performs an arm-in motion.

When the amount of return fluid from the small chamber of the cylinder ARM is rapidly increased due to the weight of the arm during a loadless movement of the arm, the orifice 8 forms a back pressure in the first fluid line 1*a* thereby preventing a rapid increase of the amount of fluid inside the line 7 at a position after the orifice 8. The orifice 8 in the above state thus prevents an increase of the amount of regenerated return fluid and thereby prevents the generation of high pressure in the first fluid line 1*a* of the arm cylinder ARM.

When a back pressure is formed in the regeneration line 11 by the valve spring 13 of the first check valve 12, the return fluid, which flows in the return-side internal line 7, opens the second check valve 6 of the regeneration branch line 5 while overcoming the preset pressure caused by the valve spring 6*a*. Thus, the return fluid is partially fed to the supply-side internal line 4 of the arm control valve CV through the regeneration branch line 5 thereby being mixed with the pressurized fluid from the pump P. The return fluid is thus partially regenerated.

As described above, the present invention provides a return fluid regeneration device of a hydraulic circuit for construction vehicles. The regeneration device has an orifice which is provided on a return-side internal line of a directional control valve of the actuator. A regeneration line is arranged between the return-side internal line and a return line extending to a return tank and is selectively connected to the return-side internal line during a weight operation of the actuator. A regeneration branch line is branched from the return-side internal line at a position after the orifice and is connected to a supply-side internal line of the control valve, thus selectively feeding the return fluid from the return-side internal line to the supply-side internal line and thereby regenerating the return fluid. The regeneration device of this invention regulates moving speed of the actuator. The device also forms a back pressure in the regeneration line by the return fluid under high pressure obtained during a weight operation of the actuator and thereby effectively prevents the generation of high pressure in the fluid supply line. The device thus prevents the generation of unnecessary high pressure in the fluid supply line. Another advantage of the regeneration device resides in that the device generates a constant pressure in the regeneration line thus preventing the generation of cavitation in the actuator.

Although the preferred embodiment of the present invention has been disclosed for illustrative purposes, those skilled in the art will appreciate that various modifications, additions and substitutions are possible, without departing from the scope and spirit of the invention as disclosed in the accompanying claims.

What is claimed is:

1. A regeneration device for feeding back return fluid to a fluid supply line for an actuator being operable by the weight of an associated working member of a construction vehicle, thereby partially regenerating the return fluid comprising:

an orifice provided on a return-side internal line of a directional control valve of said actuator;

a regeneration line arranged between said return-side internal line and a return line extending to a return tank and selectively connected to said return-side internal line during a weight operation of said actuator;

a first check valve provided on said regeneration line to selectively form a back pressure in said regeneration line; and a regeneration branch line branched from said return-side internal line at a position after the orifice and connected to a supply-side internal line of said control valve, thus selectively feeding the return fluid from said return-side internal line to said supply-side internal line and thereby regenerating the return fluid.

2. The regeneration device according to claim 1, further comprising a second check valve provided on said regeneration branch line in order to prevent the reverse flow of fluid from said supply-side internal line to the return-side internal line.

* * * * *